US009073688B1

(12) United States Patent
Gautreaux et al.

(10) Patent No.: US 9,073,688 B1
(45) Date of Patent: Jul. 7, 2015

(54) MINI CONTAINER WITH ABSORBENT BOTTOM

(71) Applicants: Thomas P. Gautreaux, Jonesboro, GA (US); Michael J. Walsh, Atlanta, GA (US)

(72) Inventors: Thomas P. Gautreaux, Jonesboro, GA (US); Michael J. Walsh, Atlanta, GA (US)

(73) Assignee: Maxwell Chase Technologies, LLC, Atlanta, GA (US)

( * ) Notice: Subject to any disclaimer, the term of this patent is extended or adjusted under 35 U.S.C. 154(b) by 0 days.

(21) Appl. No.: 14/157,907

(22) Filed: Jan. 17, 2014

(51) Int. Cl.
*B65D 81/26* (2006.01)

(52) U.S. Cl.
CPC ..... *B65D 81/264* (2013.01)

(58) Field of Classification Search
CPC ..... B65D 1/34; B65D 75/322–75/324; B65D 75/326–75/328; B65D 81/264–81/265
USPC ..... 206/204, 557; 229/407; 426/124–126, 426/129
See application file for complete search history.

(56) References Cited

U.S. PATENT DOCUMENTS

| | | | | |
|---|---|---|---|---|
| 3,151,799 | A * | 10/1964 | Engles, Jr. et al. | 426/129 |
| 3,932,575 | A | 1/1976 | Andersson | |
| 4,275,811 | A * | 6/1981 | Miller | 206/204 |
| 4,410,578 | A | 10/1983 | Miller | |
| 5,022,945 | A | 6/1991 | Rhodes et al. | |
| 5,709,897 | A * | 1/1998 | Pearlstein | 426/124 |
| 5,820,955 | A * | 10/1998 | Brander | 206/204 |
| 6,478,147 | B1 | 11/2002 | Brander et al. | |
| 6,695,138 | B1 * | 2/2004 | Colombo et al. | 206/204 |
| 6,821,587 | B2 | 11/2004 | Forbes et al. | |
| 6,983,575 | B2 | 1/2006 | Longo | |
| 7,395,923 | B2 | 7/2008 | Chou | |
| 7,771,812 | B2 * | 8/2010 | Beu et al. | 206/204 |
| 7,921,992 | B2 | 4/2011 | LaRue et al. | |
| 8,474,610 | B1 | 7/2013 | Knight et al. | |
| 8,642,102 | B2 * | 2/2014 | Field et al. | 426/129 |
| 8,895,092 | B1 * | 11/2014 | Field et al. | 426/129 |
| 2003/0057114 | A1 | 3/2003 | Brander | |
| 2003/0108643 | A1 * | 6/2003 | Hornsby et al. | 426/129 |
| 2005/0008737 | A1 * | 1/2005 | Kwon | 426/124 |
| 2006/0219578 | A1 | 10/2006 | Owensby | |
| 2010/0258471 | A1 * | 10/2010 | Enriquez et al. | 206/557 |
| 2013/0098800 | A1 * | 4/2013 | Rehmanji et al. | 206/557 |

FOREIGN PATENT DOCUMENTS

EP 1741634 A1 * 1/2007

* cited by examiner

*Primary Examiner* — Bryon Gehman
(74) *Attorney, Agent, or Firm* — Thomas/Horstemeyer, LLP

(57) ABSTRACT

A container for items such as food products that exude liquid includes a tray (12) with a liquid collection space (34) at the bottom of the tray, liquid absorbent pad (18) in said liquid collection space that includes a liquid impervious upper sheet (30), a porous bottom sheet (31) and absorbent material (32) positioned there between. Liquid exuding products are supported on the pad (18) and the tray includes a plurality of upright grooves (27) in the side wall structure that face inwardly that form liquid channels for draining liquid exuded from the food products downwardly to the recessed bottom panel of the tray where the liquid can be absorbed through the bottom sheet by the absorbent material of the pad.

3 Claims, 3 Drawing Sheets

MINI CONTAINER WITH ABSORBENT BOTTOM

FIELD OF THE INVENTION

The present invention generally relates to containers for storing and displaying foods and other products that bear liquids that are likely to be exuded from the products. More specifically, the container includes a tray with an absorbent material in the bottom of the tray, produce in the tray, and a peelable film that extends over the upper rim of the tray for closing the produce in the tray.

BACKGROUND OF THE INVENTION

Excess moisture within food storage containers can cause premature spoilage of food products which are stored in the container because the moisture provides a favorable environment for the growth and reproduction of microorganisms. Excess moisture in a food storage container also can lead to leakage of fluids from the storage container which can cause contamination of other foods and items about the container.

Attempts at controlling excess moisture in food storage containers, such as trays (rigid and flexible) and bags, have met with some success. These prior art devices include: (1) pre-formed trays or bags configured for the insertion of absorbent material such as absorbent pads or absorbent sheets with the food products resting on the absorbent material; (2) trays with built-in reservoirs arranged to trap excess moisture exuded from the products, with some of the trays including a porous cover over the reservoirs that allows fluids to drain from the product through the cover into the reservoir but which retards the fluids from reemerging past the cover following shaking or movement of the tray; and (3) trays or packs made from multiple layers of material with one layer being liquid impervious, and a second layer being liquid pervious to allow fluids to enter, and an absorbent media sandwiched between the two layers to absorb and retain the entering fluids.

Many of the food storage containers described above are sized to contain produce for at least two servings, primarily because of the demand for this size, but also because of the cost of marketing smaller sized products. But there is an increasing demand for smaller portions of foods from the food markets, particularly for products that exude liquids, such as fruits that are cut to remove the peeling or other exterior surface and to expose the interior of the food, so that the purchaser can inspect the product before purchasing the product, and so the purchaser does not have to remove the peeling, etc. from the edible portions of the food product.

Also, there is an increasing demand for "snack" foods in smaller servings in transparent containers so that the food is visually exposed and displayed and the person that is to eat the food can inspect the food before eating. In many situations the person will eat the food directly from the container, so the retention of the liquid exuded from the food in the container becomes even more important, to avoid spilling the liquid. Also, with the recent focus on obesity there is a need for single servings of fruit and vegetable.

Therefore, there exists a need for devices and methods that address these and other shortcomings of the prior art.

SUMMARY OF THE INVENTION

Briefly described the present invention concerns a container for liquid exuding produce that includes a tray with a bottom panel for resting on a horizontal surface and a raised perimeter rim oriented parallel to the bottom panel and surrounding the bottom panel, a side wall extending upwardly from the raised perimeter rim, a plurality of parallel grooves extending continuously down through the side wall and the raised perimeter rim and in communication with the bottom panel, with the grooves facing inwardly of the tray and forming drains for liquids in tray to pass the liquids from the side wall to the bottom panel of said tray.

An absorbent material may be positioned on the bottom panel of the tray for absorbing liquids moved downwardly by gravity through the grooves to the bottom panel.

The absorbent material may be a pad with opposed surfaces, with one surface of the pad being absorbent material facing the bottom panel and an opposed upper surface being a liquid impervious surface facing away from the bottom panel, with the pad forming a false bottom over the bottom panel.

The container may include liquid exuding produce in the tray that rests on the absorbent material, and a peel able impervious lidding film may be mounted to the rim of the tray to close the tray about the produce.

The produce may be, for example, sliced fruits or vegetables or other products that exude liquid, and the tray and/or the sheet may be transparent to display the produce and the liquid collected in the absorbent material in the tray.

Other features and advantages of the present invention will become apparent upon reading the following specification, when taken in conjunction with the accompanying drawings.

DETAILED DESCRIPTION

Figure 1:
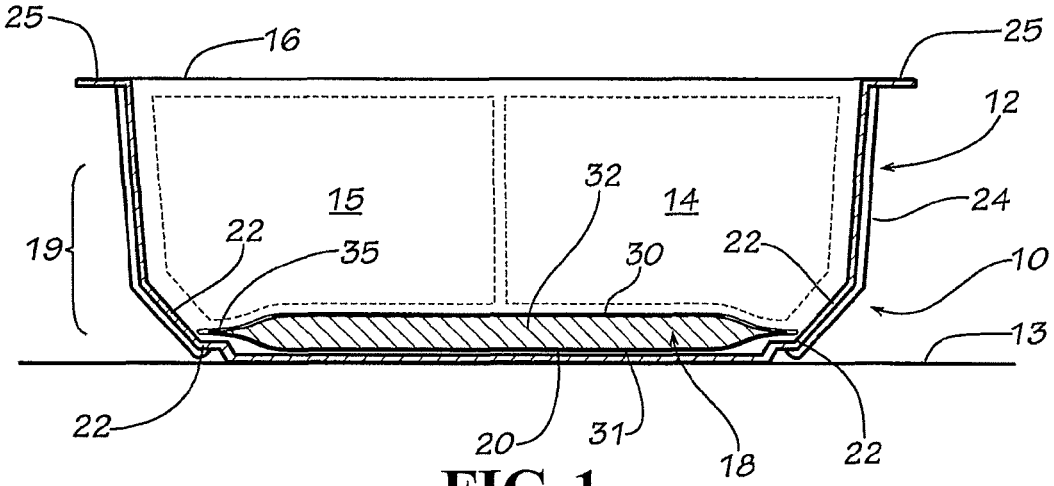
FIG. 1 is a side cross sectional view of the container that includes the tray, the liquid exuding product positioned in the tray, and the peelable impervious film applied over the product and attached to the rim of the side wall of the tray.

Referring now to the drawings wherein like reference numbers designate like parts throughout the several views, FIG. 1 shows a container 10 that includes the tray 12 for resting on a surface 13, liquid exuding food products 14 and 15 in said tray, and the peel able film 16 that is extended over the food products 14 and 15 and is attached at its edges to the tray 10. A liquid absorbent, such as liquid absorbent pad 18, is applied to the bottom of the tray and will be described in more detail hereinafter. An example of the liquid absorbent material is CMC, bentonite and aluminum potassium sulfate, an example of the peel able film is polyester film with polyethylene sealant layer.

Figure 2:
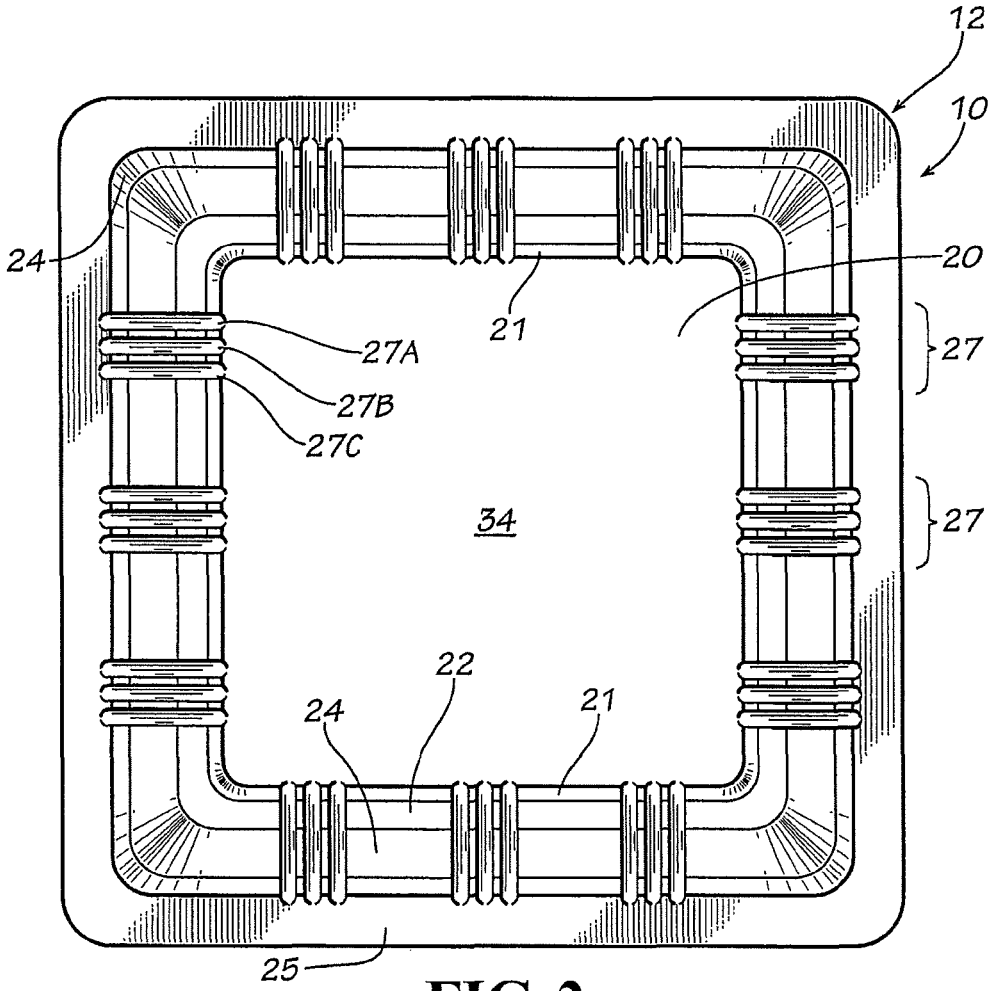
FIG. 2 is a top view of the tray of the container.
Figure 3:
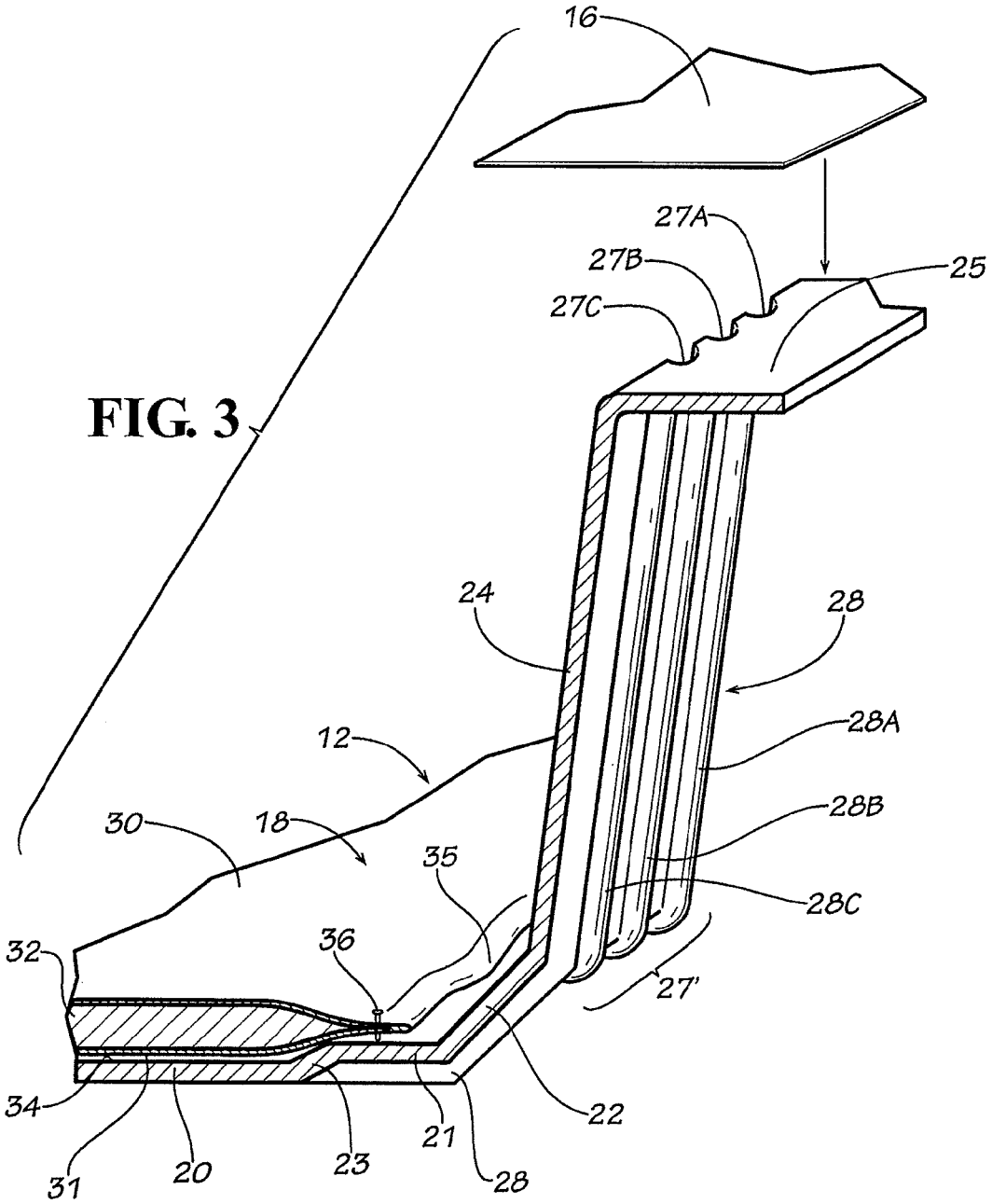
FIG. 3 is a detailed cross sectional view of a portion of the side wall and bottom panel of the tray with a portion of the absorbent pad applied over the bottom panel of the tray.

As shown in FIGS. 1-3, the tray 10 includes a bottom panel 20 that is substantially flat and forms the lowermost portion of the tray 12 for resting on the surface 13. In this embodiment, the panel 20 and the following described side wall structure 19 and rim 25 are formed in the configuration of a square. However, the tray may be formed in other shapes.

The side wall structure 19 of the four sides of the tray each includes a raised perimeter rim 21 that is joined by step 23 to bottom panel 20 and the raised perimeter rim is displaced upwardly from the level of the bottom panel and is, in this embodiment, parallel to the bottom panel. A sloped perimeter wall 22 is joined to the outer edge of the raised perimeter rim 21 and larger sloped side wall 24 extends upwardly from the upper edge of the sloped perimeter wall 22 and joins the upper rim 25. Upper rim 25 extends horizontally about the tray and is flat for engagement by the peelable film 16.

A plurality of groups of parallel grooves 27 are formed in the side wall structures 19 of the tray 12, extending upwardly through step 23, raised perimeter rim 21, sloped perimeter wall 22, sloped side wall 24, and intersecting upper rim 25. The groups of parallel grooves are illustrated individually as being three grooves 27A, 27B and 27C. The concave surfaces of the grooves 27A-270 face inwardly of the side wall structure and the convex exterior surfaces of the grooves protrude outwardly and form a plurality of groups 28 of parallel ribs 28A, 28B and 28C. The exterior ribs 28 form a strong side wall structure of the container, while the interior grooves 27 form drains for liquids moving under the influence of gravity down into the confines of the tray, toward the bottom panel 20. The bottom panel and the step 23 form a liquid collection space 34. The grooves open through step 23 onto the upwardly facing surface of the bottom panel 20. This forms open drains all the way from the upper rim 25 to the bottom panel 20, where the liquid tends to accumulate in the liquid collection space 34.

Figure 5:
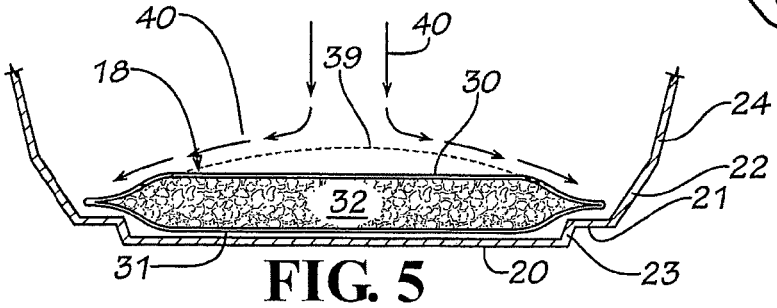
FIG. 5 is a side cross sectional view of the bottom portion of the tray, showing how the absorbent pad changes shape when liquid is absorbed in the absorbent material.

As shown in FIGS. 3 and 5, the liquid absorbent pad 18 provides a false bottom in the tray and includes an impervious upper sheet 30, a porous bottom sheet 31, and an absorbent material 32 positioned between the sheets. The edges of the two sheets are heat sealed together to retain the absorbent material in place between the sheets.

The impervious upper sheet 30 of liquid absorbent pad 18 is positioned to face upwardly into the upper confines of the container 10 and the food products 14 and 15 that might exude liquid will rest directly on the impervious upper sheet. The impervious upper sheet 30 of the absorbent pad 18 may be formed of PET/polyester with PE layer and shields the food products from contacting the absorbent material in the pad. The porous bottom sheet 31 may be formed of PP/PE fabric and rests on the recessed bottom panel 20 of the tray in the liquid collection space 34.

Other materials may be used for forming the absorbent pad.

Liquids that leak from the food products positioned in the tray tend to move downwardly under the influence of gravity toward absorbent pad 18 and the collection space 34 formed by the bottom panel 20 and the step 23.

In general, most of the liquid exuded from the food products 14 and 15 tends to reach the plurality of groups of parallel grooves 27 that face inwardly of the tray 12, providing channels that communicate around the liquid impervious upper sheet 30, leading the liquid to the liquid collection space 34 where the liquid is permitted to pass through the porous bottom sheet of the liquid absorbent pad 18, reaching the absorbent material 32 in the liquid absorbent pad 18. The absorbent material tends to hold the liquid in position at the bottom panel 20.

The liquid absorbent pad 18 is affixed at its corners to the corners of the raised perimeter rim 21 as shown in FIG. 3 with a heat fusion connection 36 (FIG. 3), leaving the intermediate edge portions about the liquid absorbent pad free to be able to pass the liquid that drains downwardly through the inwardly facing grooves 27. This connection of the liquid absorbent pad to the bottom of the tray 12 assures that the liquid from the grooves 27 reaches the collection space 34 and the absorbent material in the collection space.

Figure 4:
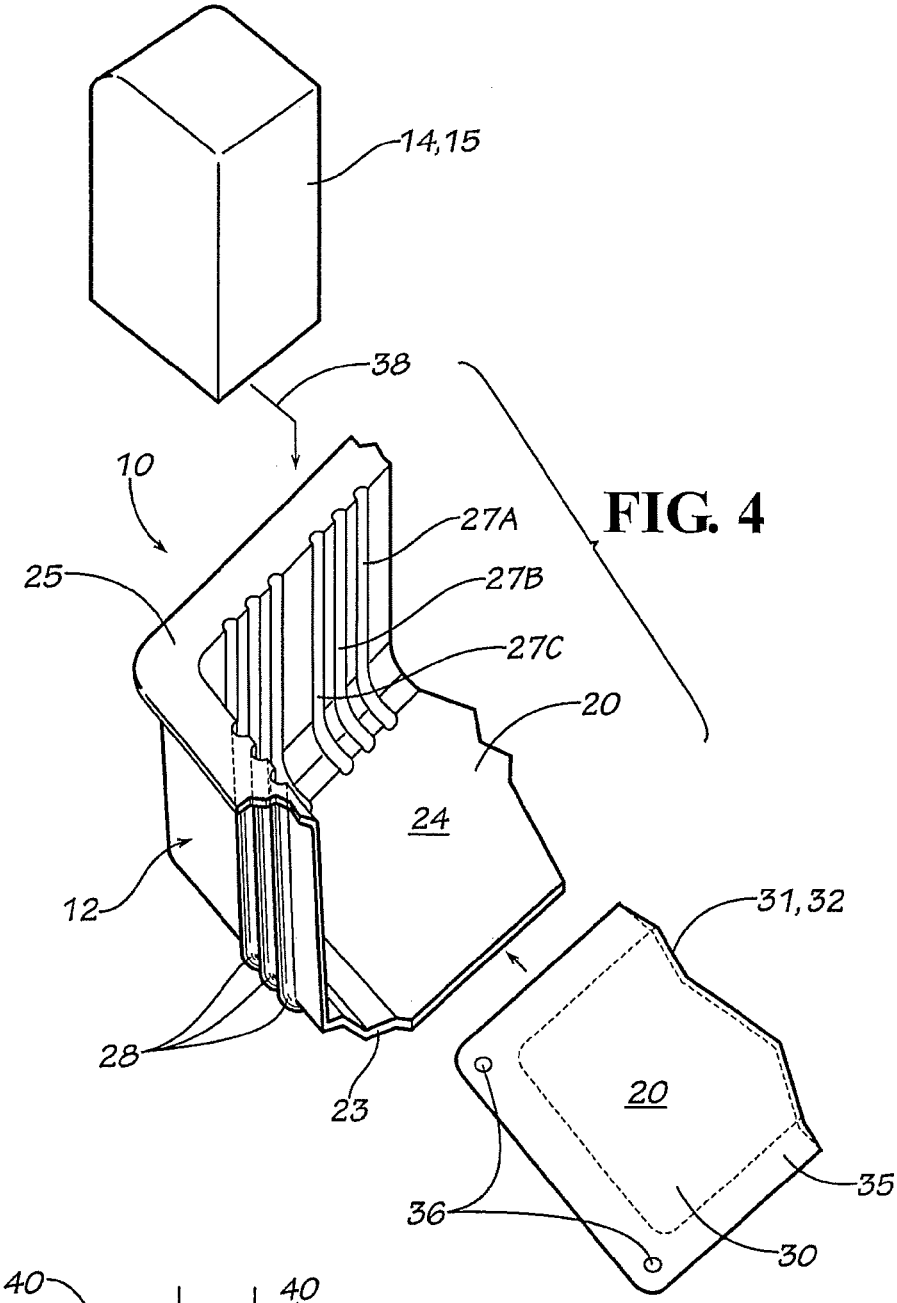
FIG. 4 is a detailed perspective view of a corner portion of the tray, showing the absorbent pad and food product spaced away from the tray.

The food products can be formed in one relatively large piece that fits snugly in the tray 12. However, as shown in FIG. 4, the food products may be sliced into geometrical shapes that are more "bite sized", such as rectangular shapes 14 and 15 with several of the food products being inserted downwardly into the confines of the tray 12. For example, large fruits such as watermelon, cantaloupe and others that can be formed into specific shapes may be inserted downwardly into the tray 12 as indicated by arrow 38 of FIG. 4. Also, smaller items, such as berries, may be placed in the container.

The foregoing described container 10 may be in various sizes, but particularly in small sizes such as 3½ inches across the top of the upper rim 25 and one or two inches deep. The shape of the container may be varied, to be higher, rectangular, or even in circular or oval shapes. Experience shows that the square shaped containers are desirable because of the ability to be efficiently arranged in a refrigerated display case, and also the small size of the containers assures that the weight of the containers stacked next above will not likely crush the food products 14 and 15 in the containers below, and will not tend to overly stretch the peel able film 16. Also, if the foods in the container are the smaller "snack" foods, it is practical to make the container as a "mini container" that holds smaller helpings of the foods for snacks eaten directly from the tray.

The liquid absorbent pad is shaped and dimensioned to be compatible with the shape of the bottom panel 20 so that it tends to "sit" into the space of the bottom panel. The heat sealed hem 35 of the liquid absorbent pad that does not contain the absorbent material is thinner than the central portion of the absorbent pad and tends to overlie the raised perimeter rim that surrounds the bottom panel. This tends to cause the liquid absorbent pad to form a false bottom in the tray that may be bypassed by the liquid headed toward the cavity of the bottom panel where the liquid will be absorbed through the porous bottom sheet 31 into the absorbent material 32. While the absorbent pad is illustrated as being connected only through the hem 25 at the four bottom corners of the tray, other locations of the connector may be used if desirable.

As shown in FIG. 5, the absorbent material 32 of the liquid absorbent pad 18 absorbs liquid exuded from the food items in the container, and the absorbent material 32 tends to swell to a larger vertical thickness, eventually forming the liquid impervious upper sheet 30 into a dome shape 39. As illustrated by arrows 40, the convex dome shape of the liquid impervious upper sheet 30 tends to guide the liquid down the slope of the dome toward the perimeter of the absorbent pad, where the liquid moves about the edge of the absorbent pad and into the collection space where the liquid tends to pass through the porous bottom sheet 31 and become absorbed by the absorbent material. The dome shape helps to reduce any tendency of the liquid impervious upper sheet pooling and trapping the liquid on the top of the liquid absorbent pad.

Although preferred embodiments of the invention have been disclosed in detail herein, it will be obvious to those skilled in the art that variations and modifications of the disclosed embodiments can be made without departing from the spirit and scope of the invention as set forth in the following claims.

The invention claimed is:

1. A container for liquid exuding produce comprising:

a tray said tray including a bottom panel, a raised perimeter rim surrounding said bottom panel and extending parallel to and above said bottom panel, a step surrounding said bottom panel and sloped upwardly from said bottom panel to said raised perimeter rim and joined to both said bottom panel and said perimeter rim and forming a liquid collection space over said bottom panel, a sloped perimeter wall extending about said raised perimeter rim and sloped upwardly from said raised perimeter rim and forming with said bottom panel, said step and said raised perimeter rim a basin for receiving liquids, a side wall structure including a lower portion connected to said sloped perimeter wall and extending upwardly from said sloped perimeter wall and including an upper portion, a rim extending outwardly from said upper portion of said side wall, a plurality of grooves extending continuously down through said rim, said sloped side wall, said sloped perimeter wall and said raised perimeter rim and said step in communication with said liquid collection space, said grooves facing inwardly of said tray and forming drains for liquids in said tray to pass to the liquid collection space.

2. The container of claim 1 and further including a liquid absorbent pad positioned in said liquid collection space, said liquid absorbent pad including a hem sized and shaped to rest on said raised perimeter rim so that the plurality of grooves extend under the hem of the liquid absorbent pad, and an absorbent material positioned in said liquid absorbent pad for absorbing liquids moved downwardly through the grooves to said collection space.

3. The container of claim 2, and wherein said liquid absorbent pad comprises a lower surface and an opposed upper surface, with said lower surface of said liquid absorbent pad comprising porous material facing said bottom panel and said opposed upper surface comprising a liquid impervious material facing away from said bottom panel, with said liquid absorbent pad forming a false bottom over said bottom panel.

* * * * *